US005261507A

United States Patent [19]

Williams et al.

[11] Patent Number: 5,261,507

[45] Date of Patent: Nov. 16, 1993

[54] LADDER STANDOFF

[75] Inventors: Danny R. Williams, Pearland; Tobe W. Williams, Houston, both of Tex.

[73] Assignee: Houston Industries Incorporated, Houston, Tex.

[21] Appl. No.: 977,653

[22] Filed: Nov. 17, 1992

[51] Int. Cl.[5] ..... E06C 7/00

[52] U.S. Cl. ..... 182/214; 182/229

[58] Field of Search ..... 182/214, 107, 229, 122

[56] References Cited

U.S. PATENT DOCUMENTS

| | | | |
|---|---|---|---|
| 783,259 | 2/1905 | Friend | 182/214 |
| 799,782 | 9/1905 | Ellinger | 182/214 |
| 1,471,848 | 10/1923 | Johnson | 182/214 X |
| 2,599,169 | 6/1952 | Finney | 187/214 |
| 2,797,037 | 6/1957 | Niedojadlo . | |
| 3,288,249 | 11/1966 | Gibson | 182/214 |
| 3,713,510 | 1/1973 | O'Dell | 182/214 X |
| 4,061,203 | 12/1977 | Spencer et al. | 182/214 |
| 4,331,217 | 5/1982 | Stecklow | 182/214 |
| 4,339,020 | 7/1982 | Wiseman | 182/214 |
| 4,359,138 | 11/1982 | Kummerlin et al. | 182/214 |
| 4,369,860 | 1/1983 | Beane | 182/214 |
| 4,394,887 | 7/1983 | Spinks | 182/214 |
| 4,502,566 | 3/1985 | Wing | 182/214 |
| 4,754,842 | 7/1988 | Southern | 182/111 |
| 4,765,439 | 8/1988 | Kresmery | 182/107 |
| 4,823,912 | 4/1989 | Gould et al. | 182/214 |
| 4,932,498 | 6/1990 | Miller | 182/214 |
| 4,971,167 | 11/1990 | Winnard | 182/107 |

FOREIGN PATENT DOCUMENTS

| | | | |
|---|---|---|---|
| 624292 | 7/1961 | Canada | 182/214 |

OTHER PUBLICATIONS

Catalog of R. D. Werner Co., Inc.; "Werner Ladders"; May, 1991; cover pages and pp. 42–43.

*Primary Examiner*—Alvin C. Chin-Shue

*Attorney, Agent, or Firm*—Pravel, Hewitt, Kimball & Krieger

[57] ABSTRACT

An apparatus is provided for fitting at an upper portion of a ladder. It is adapted for use in situations where an electrical service crew member must work on electrical equipment (such as transformer boxes) which are mounted on upper portions of building walls. The apparatus provides a safe and stable support for the ladder. The apparatus provides this support while keeping the ladder located an adequate distance from the wall. The crew member can thus comfortably stand on the ladder and still have access to the equipment to remove the cover of the box and work on its contents.

9 Claims, 3 Drawing Sheets

LADDER STANDOFF

BACKGROUND OF THE INVENTION

1. Field of the Invention

The present invention relates to supporting attachments or standoffs for ladders.

2. Description of Prior Art

In certain work or repair situations, it is necessary for a member of the service crew to work on equipment located in awkward positions. One of the most common is when the equipment is mounted extending outwardly from a wall at a height above ground level. The worker needed a ladder or support on which to stand to reach the equipment. The ladder would be placed against the wall at its upper end for support. However, since the equipment on which work was needed extended outwardly from the wall, it was awkward for the worker. Often, the worker once standing high enough on the ladder to reach the equipment was so close to the wall that it was necessary to lean backward from the ladder to be able to repair or service the equipment.

There have been a number of supports or standoffs proposed in the prior art for use in these situations. U.S. Pat. Nos. 2,797,037; 4,061,203 and 4,502,566 relate to supports or attachments of this type. Rather than being specifically designed for certain types of ladders, each of these supports was adapted for use on general purpose ladders. The supports were also removable from the ladder and connectable at various locations or heights on the ladder. There has been some concern, however, about the ability of these connections to the ladder to adequately bear the ladder user's weight and transfer it to the ladder.

The wall standoff apparatus of U.S. Pat. No. 4,502,566, for example, was connected to the side rails of the ladder by clamping jaws. The ladder attachment of U.S. Pat. No. 4,061,203 had U-bolt fasteners which fitted over the juncture of a ladder rung with the ladder side rails. The ladder support of U.S. Pat. No. 2,797,037 utilized adjustably positioned plate or channel members mounted at spaced positions on opposite sides of each ladder rail for connection purposes.

The structures of U.S. Pat. Nos. 4,331,217; 4,359,138; 4,369,860 and 4,394,887 primarily involved spacer mechanisms interposed between an upper portion of the ladder and the supporting wall or roof surface. Certain of these spacer mechanisms made provisions for shelves or surfaces for support of tools, paint or work items which the ladder user might need.

U.S. Pat. Nos. 4,754,842; 4,339,020 and 4,823,912 related to protective pads attached on those portions of ladder supports. These pads served to protect against slippage of the ladder and support on the wall surface. They also reduced the likelihood of damage or marking of the wall surface.

SUMMARY OF INVENTION

Briefly, the present invention provides a new and improved ladder standoff apparatus for supporting a ladder at a spaced position from a surface or wall on which work was to be performed, such as an item of wall mounted equipment. The apparatus of the present invention permits a user of the ladder to work on items on the wall such as items of equipment extending outwardly from the wall, the wall itself or the wall surface without having to unsafely lean or assume an unbalanced position.

The apparatus of the present invention supports a ladder against a wall to permit a ladder user to work on items on the wall. The apparatus includes connector yoke members for fitting on a rung of the ladder and channel members for fitting along and receiving rails or side members of the ladder. The connector yoke and channel members are connected to each other in a manner to fit onto the ladder and provide stability and support to the ladder user.

The apparatus also includes spacer arm members which extend inwardly from the channel members to space the ladder from the wall. Contact uprights are formed extending from the spacer arm members to engage the wall and transfer the load of the ladder to the wall.

DESCRIPTION OF THE PREFERRED EMBODIMENT

Figure 1:
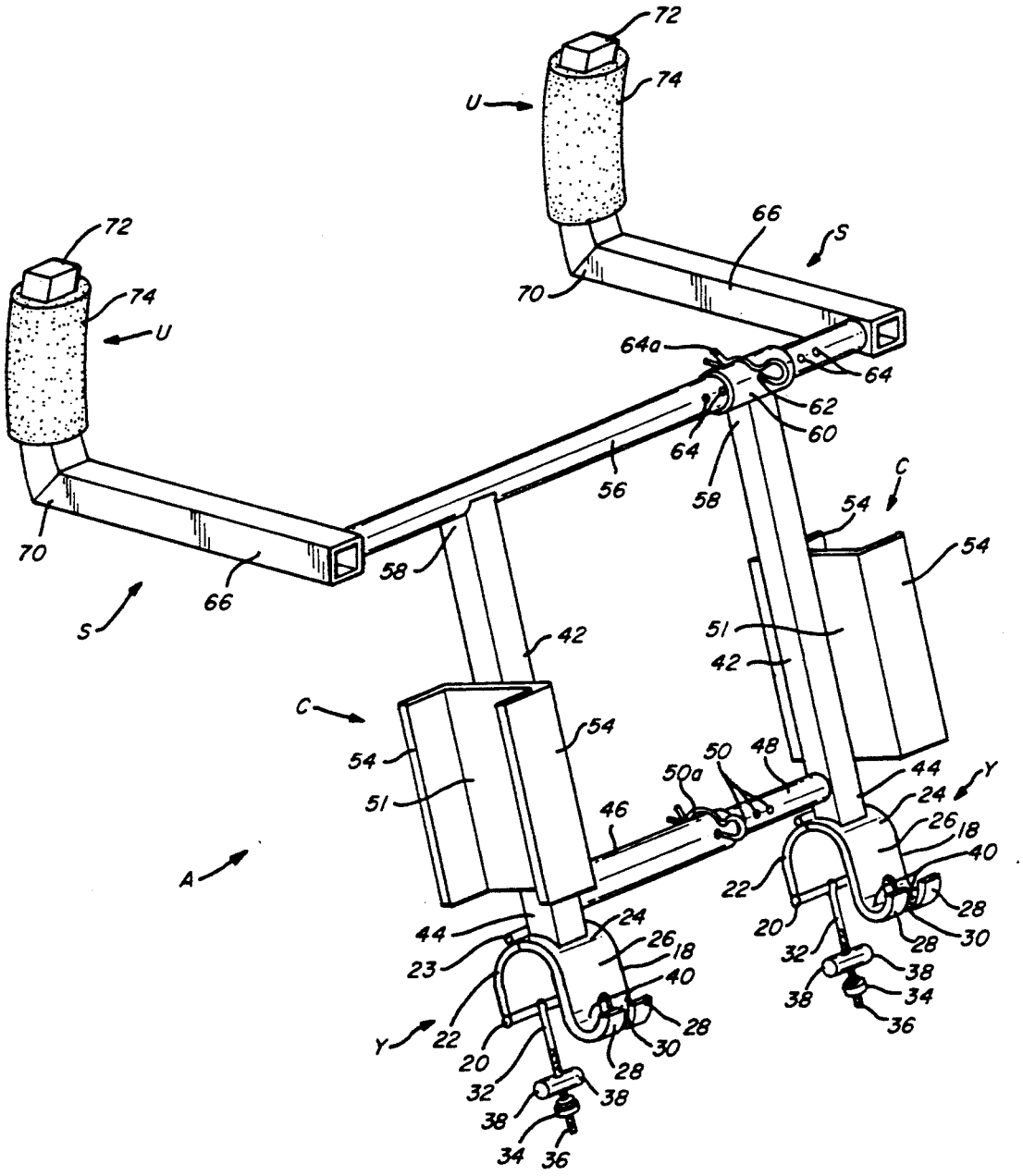
FIG. 1 is an isometric view of a ladder standoff or support apparatus according to the present invention.

In the drawings, the letter A designates generally an apparatus for supporting a ladder L against a wall W to permit a ladder user to work on items on the wall W. The ladder L, as is conventional, has a number of rungs 10 formed extending between upright side rails or members 12. The rungs 10 may be cylindrical in cross-section, rectangular or square, as desired.

In the embodiment in the drawings, the item on the wall is a box B containing electrical power distribution equipment, known as a C.T. box. It should be understood, however, that other items or types of equipment on the wall W or even the wall itself or its surface or structure above the wall W may be serviced or repaired by the ladder user.

The ladder includes a pair of connector yoke members Y spaced from each other for fitting over spaced portions 14 and 16 of an upper one of the ladder rungs 10. The yoke members Y are generally inverted U-shaped members 18 in the embodiment shown. Other shapes conforming to differing cross-sections of ladder rungs 10 could be used as well, if desired, such as rectangular, cylindrical or the like.

The yoke members Y are formed extending upwardly from a pivot sleeve 20 along a rear portion 22 to a hinged connection 23 near a central span 24. The yoke members Y each extend downwardly from the central span 24 along a front portion 26 to a connector hook pair 28 formed extending outwardly along sides of a connector slot 30.

A threaded connector pin 32 is pivotally mounted extending outwardly from an axle or rod 31 in each of the pivot sleeves 20. The threaded connector pins 32 are adapted to receive a threaded locking nut or washer 34 at an outer end 36. The locking nuts 34 are each movable inwardly on the connector pins 32 into engagement with one of the connector pairs 28. Connector fingers or probes 38 are formed on the connector pins 32 inwardly from their outer ends 36. The connector fingers 38 fit within spaces 40 rearwardly of the connector hook pairs 28 of each of the yoke members Y.

Figure 2:
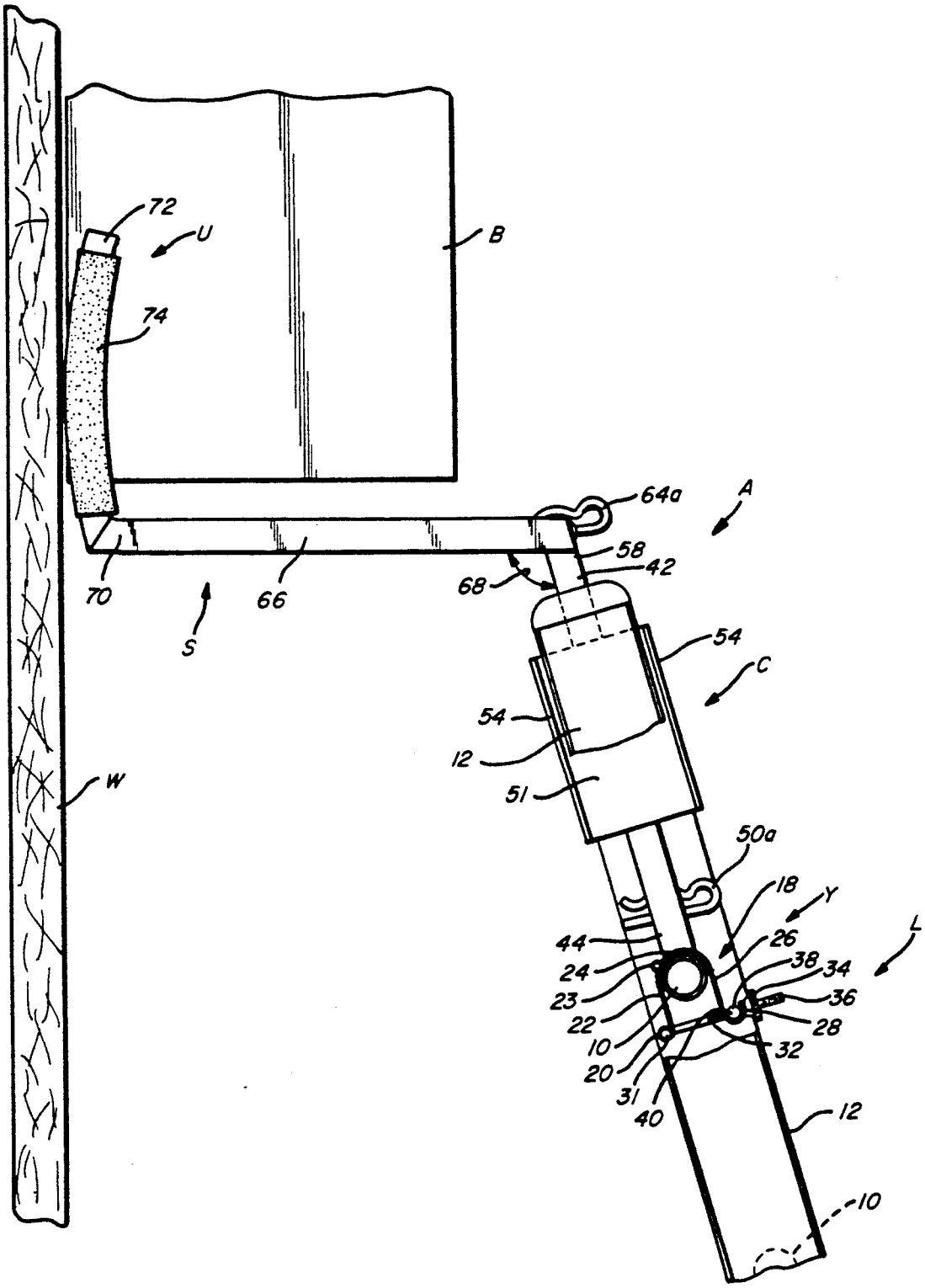
FIG. 2 is an elevation view of an apparatus according to the present invention supporting a ladder against a wall on which an item of equipment is mounted.
Figure 3:
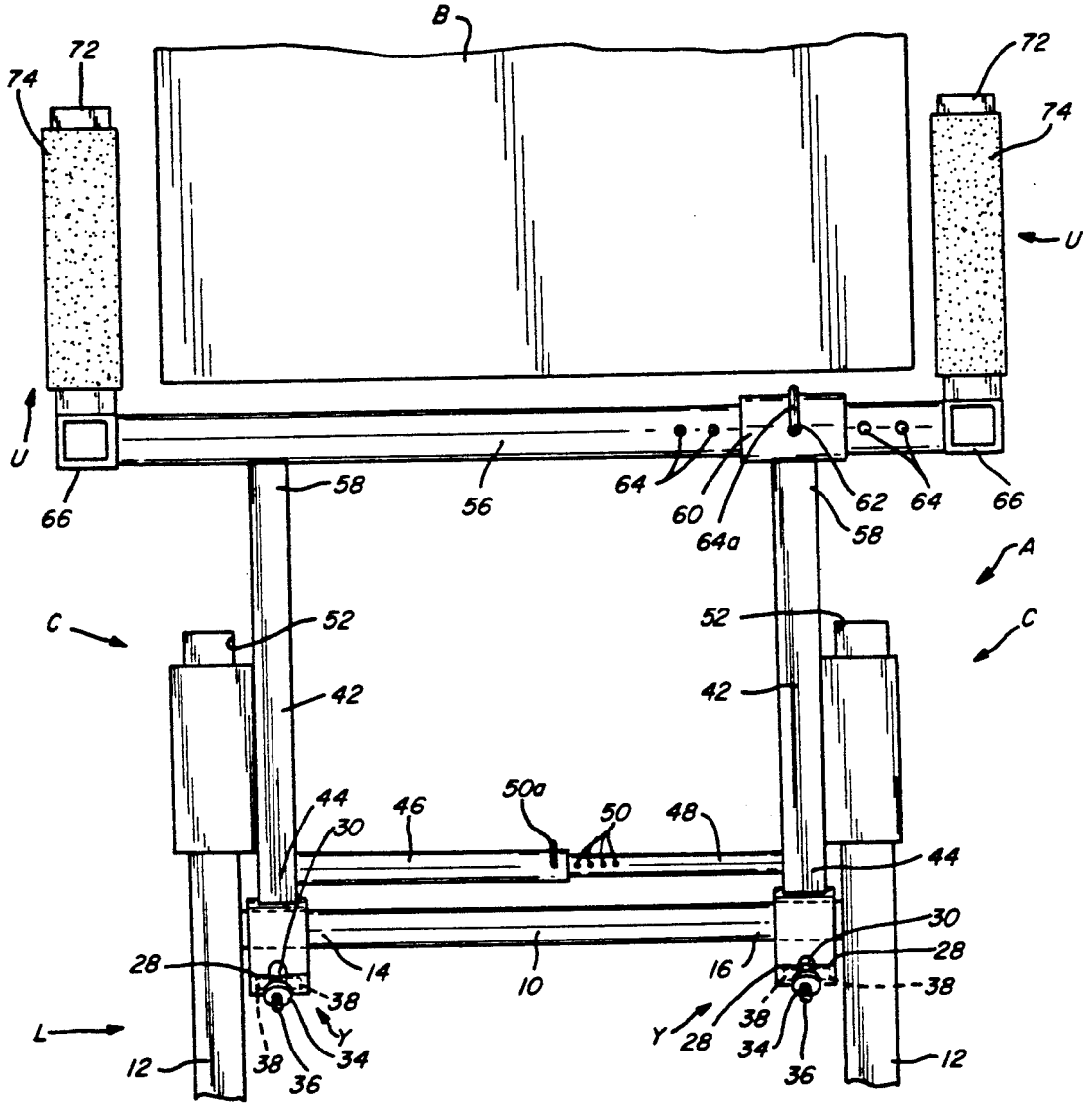
FIG. 3 is an elevation view of an apparatus according to the present invention on an upper portion of a ladder adjacent an item of equipment on a wall.

When the yoke members Y are fitted over the appropriate ladder rung 10, the connector pins 32 are pivoted upwardly until the connector fingers 38 are fitted (FIG. 2) within the space 40 rearwardly of the connector hooks 28. The locking nuts 34 are then threaded downwardly over the connector pins 32 until firm contact is made with connector pairs 28. When this is accomplished, the ladder rung 10 is enclosed within the yoke members Y and the apparatus A is attached to the ladder L.

Extending upwardly from each of the yoke member Y are support beams 42. The support beams 42 are connected at lower portions 44 to each other by telescoping sleeve members 46 and 48. Spaced openings or ports 50 are formed on each of the telescoping sleeve members 46 and 48. The sleeve member 46 and 48 are movable with respect to each other to adjust the relative lateral spacing between the support beams 42. When the support beams 42 are at the desired lateral spacing from each other, a pin or bolt 50*a* or other suitable connector is inserted through an aligned pair of the openings or ports 50 and suitably secured. In this manner, the relative lateral spacing of the support beams 42 and consequently the yoke members Y from each other may be adjusted.

A pair of outwardly facing channel members C are mounted on the support beams 42 extending along the length of the ladder rails 12 above the yoke member Y. The channel members C have central portions 51 for contacting outer side surfaces 52 of the ladder rails 12. Channel legs 54 are formed extending outwardly from each side of the central portion 51 of the channel member C to receive the ladder rails 12.

It is to be noted that the channel members C are located above the connection of the yoke members Y with the ladder L. Thus, in the event there should be any tendency of the apparatus A to pivot under load at the connection of the yoke member Y with the ladder rung 10, channel members C fitted extending along the ladders rails 12 and in contact therewith tend to counteract any such turning moment or force.

A cross bar 56 is fitted above and between an upper portion 58 of one of the support beams 42 and a sleeve member 60 mounted to a similar upper portion 58 above the other support beam 42. The sleeve member 60 is relatively slideably movable along the cross bar 56 and has an opening 62 formed therein which may be aligned with any of several spaced openings 64 along the cross bar 56. The sleeve member 60 may thus move laterally along the cross bar 56 as the telescoping sleeve members 46 and 48 are moved to adjust the lateral spacing of the yoke members Y. When the desired lateral spacing is achieved, a locking pin 64*a* or bolt is inserted through the aligned openings 62 and 64 and secured to lock the support beams 42 at their desired lateral spacing from each other at their upper ends 58.

Spacer arm members S are formed extending inwardly from the channel members C and the cross bar 56. The spacer arm members S are rods or beams 66 which may be of any suitable cross-section and may be solid or hollow, rectangular or tubular. The rods or beams 66 of spacer arm member are suitably long, such as a foot or more, to achieve the required spacing of the ladder L from the wall W. The spacer arm members S are preferably formed extending at an angle 68 (FIG. 2) of approximately 105° to support beams 42. In this way, the ladder L will be tilted at an angle with respect to a vertical wall W so that the ratio of horizontal to vertical extent is one foot of horizontal extent for each four feet of vertical extent, a commonly used safety and stability factor for ladders.

Contact upright members U are formed extending upwardly at inner ends 70 of each of the spacer arm members S. The contact upright members U are preferably arcuate or curved members in their upward extent so that they may adaptably engage the surface of the wall W at varying angles of contact depending upon the surface material of the wall W and the angle of contact between the apparatus A the wall surface.

The contact upright member U are rods or bars 72 which may be rectangular or tubular in cross-section, as desired. It is also typical to provide padded sleeve members 74 which slide downwardly over and fit over the contact upright members U. The padded sleeve members 74 serve to provide protection against slippage of the apparatus A and ladder L along the wall W. The padded sleeve members 74 also serve to protect the surface of the wall W during use of the ladder L to work on the box B.

In the operation of the present invention, the relative spacing of the telescoping sleeve members 46 and 48 and the position of the sleeve member 60 along the cross bar 56 are adjusted to fit the rung 10 of the ladder L with which the apparatus A is to be used. The channel members C are then fitted along the ladder rails 12 as the yoke members Y are fitted over and attached to the desired one of the upper rungs 10 of the ladder L. The apparatus A is then in position for use with the ladder L.

The ladder L is then moved to is desired location near the wall W and tilted toward the wall W until the upright members U contact the surface of the wall W at or beneath the box B. A service crew member or ladder user can then scale the ladder L to work on the box B. When so working, the crew member is able to safely stand in an upright position spaced from the wall W by the length of the spacer arm members S. This can be done without requiring the crew member to lean backwardly to perform the required work.

As has been pointed out, the channel members C are fitted along the length of ladder rails 12 above the connection of the yoke members Y to the ladder L. Thus, any tendency of the apparatus A to pivot or rotate at the yoke members Y with respect to the ladder L under load is counteracted by the engagement of channel member C along the ladder rails 12.

Having described the invention above, various modifications of the techniques, procedures, material and equipment will be apparent to those in the art. It is intended that all such variations be included within the scope and spirit of the appended claims.

We claim:

1. An apparatus for supporting a ladder against a wall to permit a ladder user to work on items on the wall, comprising:

a plurality of connector yokes spaced from each other for fitting over spaced portions of a rung of the ladder;

channel members formed extending along the length of the rails of the ladder for fitting along and receiving rails of the ladder, said channel members comprising:

a central portion for contacting outer side surface portions of the rails of the ladder;

channel legs extending from each side of said central portion along the rail of the ladder to receive same in said channel member;

spacer arm members extending inwardly above said channel members for spacing the ladder from the wall;

support beam members extending upwardly from each of said plurality of connector yokes to said spacer arm members;

said channel members being mounted on said support beam members between said connector yokes and said plurality of spacer arm members; and contact upright members formed extending from said spacer arm members for engaging the wall and transferring the load of the ladder to the wall.

2. The apparatus of claim 1, further including:

means for adjusting the relative spacing of said plurality of connector yokes from each other.

3. The apparatus of claim 1, wherein:

said spacer arms are mounted at an angle of approximately 105° to said support beam members.

4. The apparatus of claim 1, further including:

crossbar means connecting spacer arm members to said support beam members.

5. The apparatus of claim 4, further including:

means with said crossbar means for adjusting the relative spacing of spacer arm members.

6. The apparatus of claim 1, wherein each of said connector yokes comprises:

a downwardly facing yoke for receiving a rung of the ladder therein.

7. The apparatus of claim 6, wherein each of said downwardly facing yokes comprises:

a yoke member conforming in shape to the shape of the ladder rung.

8. The apparatus of claim 1, wherein:

said contact upright members are arcuate in their upright extent to adaptably engage the wall surface at varying angles.

9. The apparatus of claim 1, wherein the ladder rails have top portions and wherein:

said support beam member are formed extending upwardly from said plurality of connector yokes above the top portions of the ladder rails.

* * * * *